US005624141A

United States Patent [19]

Kuo et al.

[11] Patent Number: 5,624,141

[45] Date of Patent: Apr. 29, 1997

[54] LOCK ASSEMBLY FOR RETRACTING A DOOR LATCH

[75] Inventors: Ching-Chuan Kuo, Chia-Yi Hsien; Ming-Shyang Chiou, Chia-Yi; Tong-Pei Wu, Chia-Yi Hsien; Sheen-Youl Gao, Yun-Lin Hsien, all of Taiwan

[73] Assignee: Tong-Lung Metal Industry Co., Ltd., Taiwan

[21] Appl. No.: 518,798

[22] Filed: Aug. 23, 1995

[51] Int. Cl.[6] ..... E05C 1/12

[52] U.S. Cl. ..... 292/165; 292/336.3; 292/358

[58] Field of Search ..... 292/165, 358, 292/336.3

[56] References Cited

U.S. PATENT DOCUMENTS

| | | | |
|---|---|---|---|
| 1,099,659 | 6/1914 | Mason | 292/165 |
| 2,483,368 | 9/1949 | Ledin | 292/165 |
| 3,257,138 | 6/1966 | Russell et al. | 292/336.3 |
| 5,088,778 | 2/1992 | Lin | 292/336.3 |

*Primary Examiner*—Rodney M. Lindsey

*Attorney, Agent, or Firm*—Ladas & Parry

[57] ABSTRACT

A lock assembly includes a linkage mechanism which is operable from the outside of a door via a lever and which is drivingly connected to a latch. An inside operating mechanism which is operable from the inside of the door is connected to the linkage mechanism so that the inside operating mechanism need not be connected to the latch. The lock assembly is suitable for use with a latch having only one cam wheel or two cam wheels.

8 Claims, 7 Drawing Sheets

LOCK ASSEMBLY FOR RETRACTING A DOOR LATCH

BACKGROUND OF THE INVENTION

1. Field of the Invention

The invention relates to a door lock assembly, and particularly, to an improvement of a lock assembly to control a door latch.

2. Description of the Related Art

A typical lock assembly is shown in FIGS. 1 to 3 and comprises a housing 1000 to be mounted on the outer side of a door, a lever 2001 operable from the outside of a door, a lever operated linkage mechanism provided inside an inner casing 2000, an inner knob 4000 associated with an inner cap 3000 and a latch 5000 to be operated by the linkage mechanism. The lock assembly additionally comprises a key operated lock 2003 above the lever 2001 to control a deadbolt (not shown). When the lever 2001 is pressed, it actuates the components of the linkage mechanism in a manner shown by FIGS. 2 and 3 (please see arrows) so that a transmission rod 2002 moves a cam wheel 5001 which in turn retracts the latch 5000. The inner cap 3000 houses a mechanism cooperable with the inner knob 4000 to actuate a cam wheel 5002 and to thereby retract the latch 5000.

In the aforementioned lock assembly, the mechanism that actuates the latch 5000 from the outside of the door is independent from that which actuates the latch 5000 from the inside of the door. Therefore, a latch of the type having two cam wheels 5002 and 5001 must be used for connection with two independent actuation mechanisms. Various forms of latches are in existence. It is desirable to provide a lock assembly of the above-mentioned type that accommodates a latch which has only one cam wheel or two cam wheels.

SUMMARY OF THE INVENTION

An object of the invention is to provide a lock assembly of the above-mentioned type having an outside operating mechanism which is drivingly connected to a latch and an inside operating mechanism which is connected to the outside operating mechanism, whereby the inside operating mechanism need not be connected to the latch and whereby the lock assembly may use a latch of the type having only one cam wheel, if desired.

According to one aspect of the invention, a lock assembly comprises a housing with a base wall, and an outside operating member, such as a lever, which is mounted on the base wall for manipulation from the outside of the door and which has a drive end extending into the housing through the base wall. A linkage mechanism which is operable by the outside operating member is mounted on the base wall inside the housing adjacent to the drive end of the operating member. A transmission rod is connected to the linkage mechanism to retract the latch when the outside operating member is operated. An inside operating spindle extends into the housing from the inside of the door for manipulation.

The linkage mechanism includes a transmission plate mounted coaxially with and drivingly connected to the transmission rod for simultaneous rotation. A spindle operated mechanism which is mounted inside the housing includes a cam member and a crank member. The cam member is turnable independently of the linkage mechanism about an axis parallel to and offset from the axis of rotation of the transmission rod and is connected to the operating spindle for simultaneous rotation therewith. The crank member is turnable about an axis parallel to and offset from the axis of the cam member. When the camming face of the cam member pushes the crank member, the crank member transmits the movement of the cam member to the linkage mechanism so as to retract the latch mechanism.

In another aspect of the invention, the axis of rotation of the cam member is coaxial with the transmission rod and the transmission plate which is sleeved on the transmission rod. The transmission rod has a through-bore through which the inside operating spindle rotatably passes to engage the cam member so as to rotate the same independently of the transmission rod and the transmission plate. The crank member is coaxial with one of the remaining components of the linkage mechanism in such a manner that the linkage mechanism is actuated by the crank member when the inside operating spindle operates.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
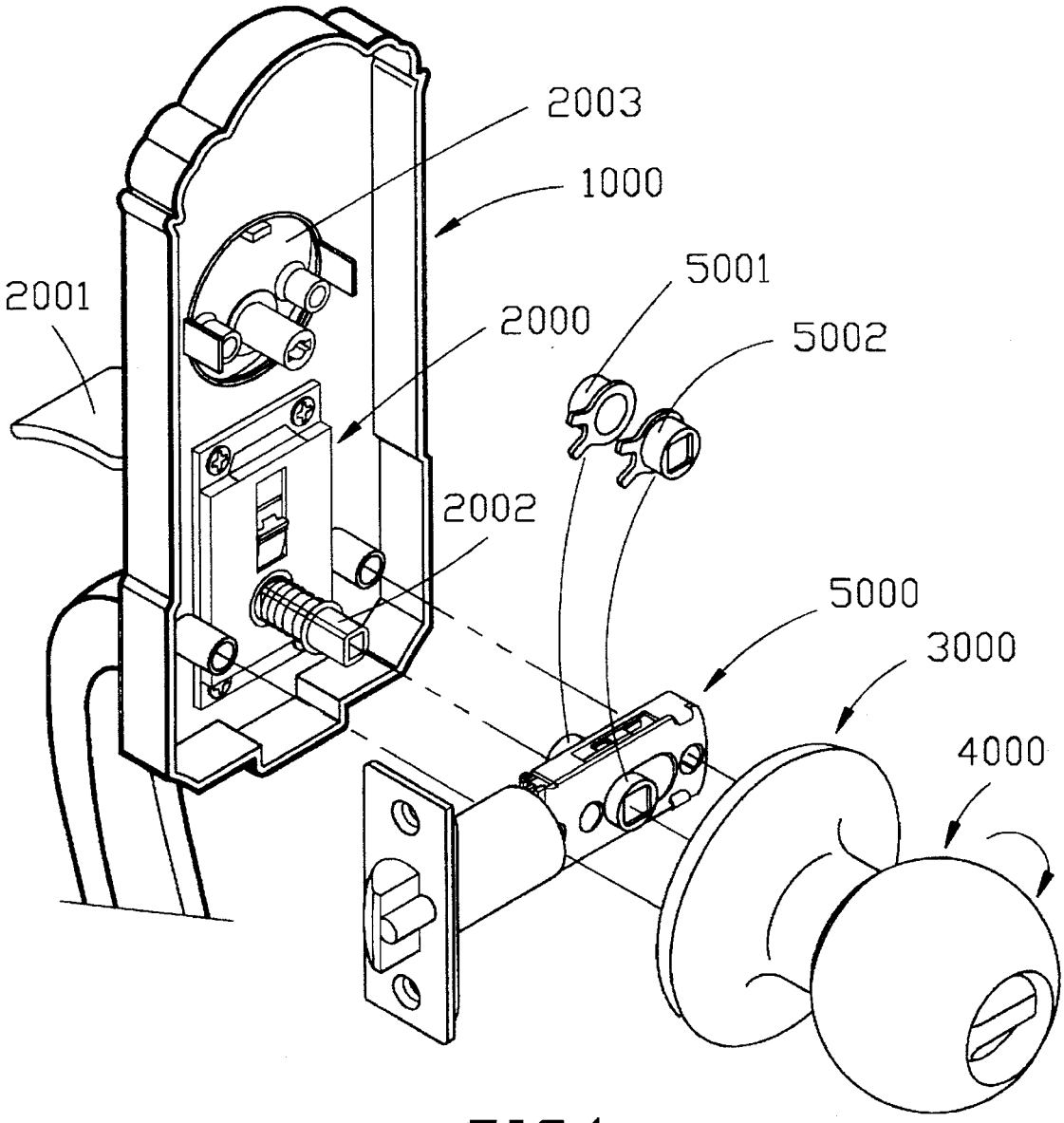
FIG.1 (PRIOR ART)
FIGS. 1 to 3 show a conventional lock assembly.
Figure 2:
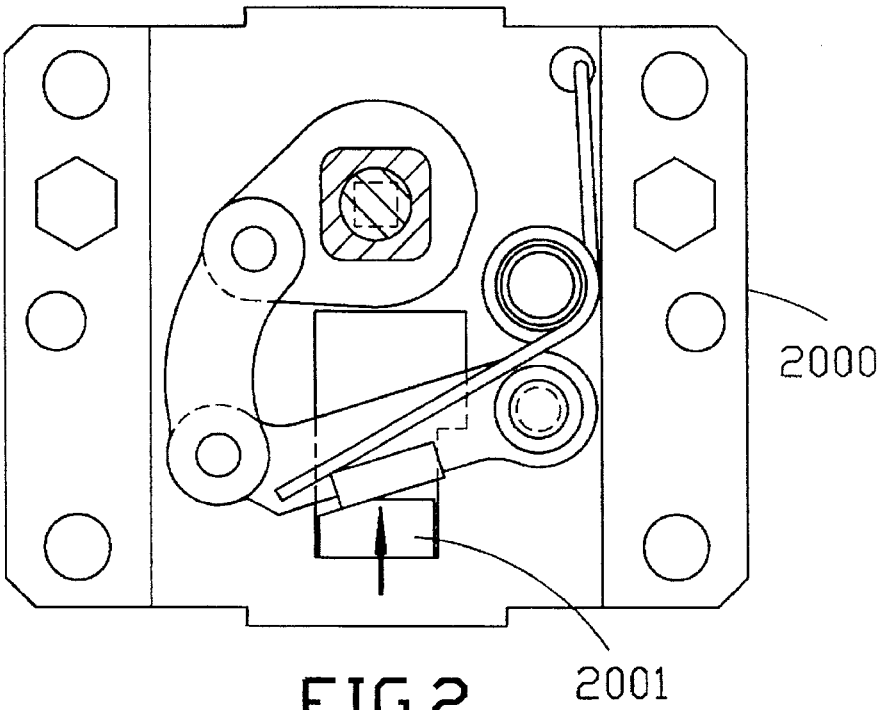
FIG.2 (PRIOR ART)
Figure 3:
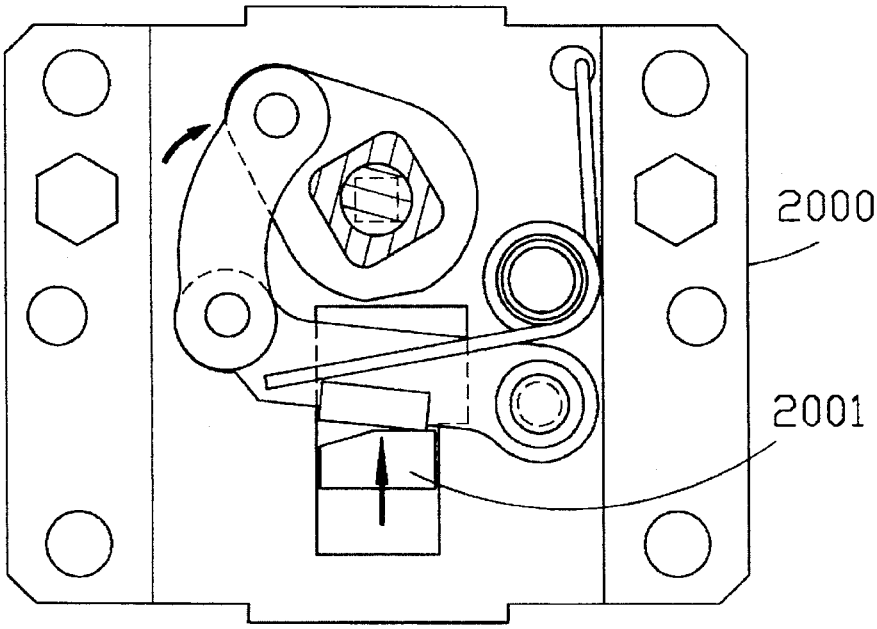
FIG.3 (PRIOR ART)
Figure 4:
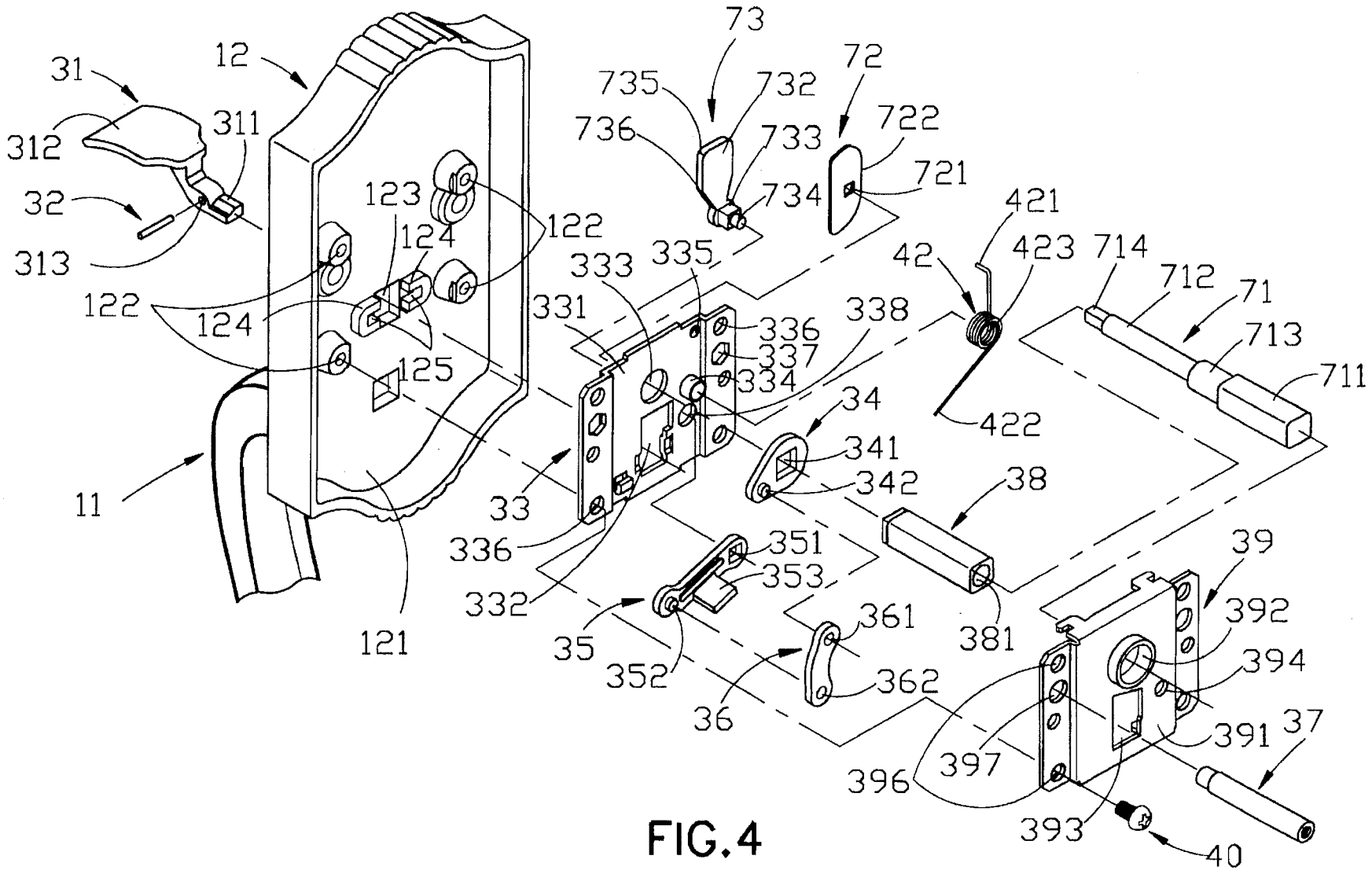
FIG. 4 shows an exploded view of a lock assembly incorporating a preferred embodiment of the present invention.

Referring to FIG. 4, a lock is shown, having a housing 12 which is connected to one end of a substantially U-shaped handle 11 (only shown in part) and which is to be mounted on an outside of a door. The housing 12 has a base 121 on which four threaded sockets 122 are formed for attachment of an inner casing constituted by two cover plates 33 and 39. The base 121 is provided with a lever hole 123 and two opposite projections 124 each of which has a recess 125.

A lever 31 has a press portion 312 and a drive end 311. The drive end 311 passes through the lever hole 123 of the base 121, and a pivot pin 32 passes through a pivot hole 313 of the lever 31. The pivot pin 32 has two ends fixed in the recesses 125 of the projections 124, thereby mounting pivotally the lever 31 to the base 121.

A linkage mechanism is provided in the inner casing formed by the cover plates 33 and 39. The linkage mechanism is known and comprises a lever actuated member 35, a connecting plate 36 and a transmission plate 34.

The cover plate 33 has two opposite end portions abutting the threaded sockets 122 and an intermediate indented part 331. The indented part 331 is provided with a hole 332 aligned with the lever hole 123, a circular hole 333 above the hole 332, a stud 334 and two additional holes 335 and 338. In addition, two holes 337 and four holes 336 which are aligned with the four sockets 122 of the housing 12 are provided at two end portions of the cover plate 33.

The transmission plate 34 is mounted on the indented part 331 of the cover plate 33 and has a rectangular hole 341 for passage of a transmission rod 38. A stud 342 is formed at one end portion of the transmission plate 34.

The lever actuated plate 35 has a rectangular hole 351, a stud 352 and a prong 353. The prong 353 is adapted to be acted upon by the drive end 311 of the lever 31 for movement of the drive plate 35.

The connecting plate 36 has two ends respectively formed with a hole 361 and 362. The connecting plate 36 is connected to the transmission plate 34 and the lever actuated plate 35 by inserting the stud 342 of the transmission plate 34 and the stud 352 of the lever actuated plate 35 into the holes 361 and 362, respectively.

The transmission rod 38 has a rectangular cross-section and has one end passing through the rectangular hole 341 of the transmission plate 34 and the circular hole 333 of the cover plate 33. The other end of the transmission rod 38 is connected to a conventional latch (not shown) which has one cam wheel or two cam wheels. The transmission rod 38 further has a through-bore 381 to receive a portion of an inside operating spindle 71.

The cover plate 39 has an intermediate protruded part 391 which is provided with a circular hole 392 in alignment with the circular hole 333 of the cover plate 33 for passage of the transmission rod 38. The cover plate 39 further has a hole 393 which is aligned with the hole 332 of the cover plate 33 for passage of the prong 353 of the lever actuated plate 35. Additional holes 396 and 397 are provided in the cover plate 39 and are in alignment with the holes 336 and 337 of the cover plate 33. Screws 40 are threadedly inserted into the holes 396 and 336 so as to fasten the cover plates 33 and 39 together. A pair of female screw rods (only one is shown) pass through the holes 397 and 337 of the cover plates 39 and 33.

A spring 42 has a coiled portion sleeved on the stud 334 of the cover plate 33. A hook 421 of the spring 42 engages in the hole 335 of the cover plate 33 while another end 422 of the spring 42 abuts against the prong 353 of the lever actuated plate 35 so that the drive plate 35 can return to its original position after being acted upon by the lever 31.

According to the invention, the lock assembly is characterized in that it comprises a cam member 72 operable by the inside operating spindle 71 in connection with an inner knob (not shown), and a crank member 73 which transmits the actuating movement of the cam member 72 to the linkage mechanism to retract the latch.

The inside operating spindle 71 has an end portion 711 for connection with a conventional knob (not shown) that is operable at the inside of a door. Another end portion 712 of the spindle 71 extends into the through hole 381 of the transmission rod 38. The spindle 71 further has an intermediate portion 713 which has a cross-section greater than that of the end portion 712. The end portion 712 of the spindle 71 has an engaging end 714.

The cam member 72 has a camming face 722 and a hole 721 engaging the engaging end 714 of the spindle 71 for simultaneous rotation with the spindle 71.

The crank member 73 has a crank plate 732, a crank shaft 733 of rectangular cross-section extending into the circular holes 338 and the rectangular hole 351, and a circular protrusion 734 extending from the crank shaft 733 so as to be journalled in the hole 394 of the cover plate 39.

Figure 5:
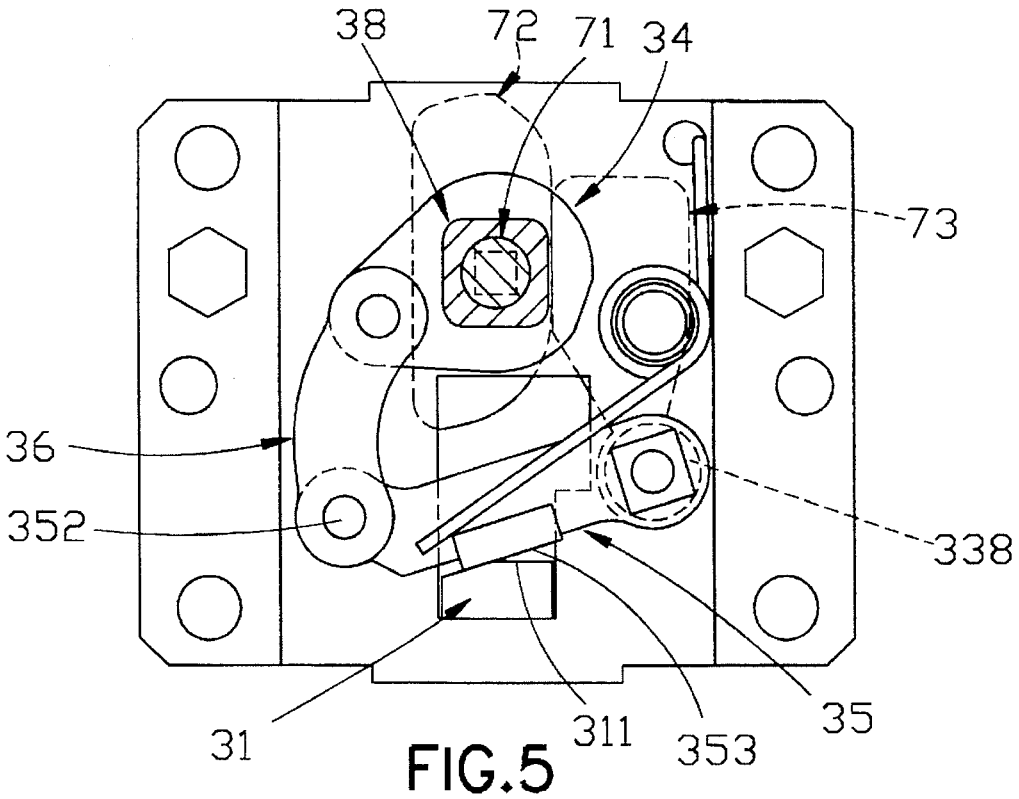
FIGS. 5 and 6 show the operation of the linkage mechanism by manipulating the outside operating member.
Figure 6:
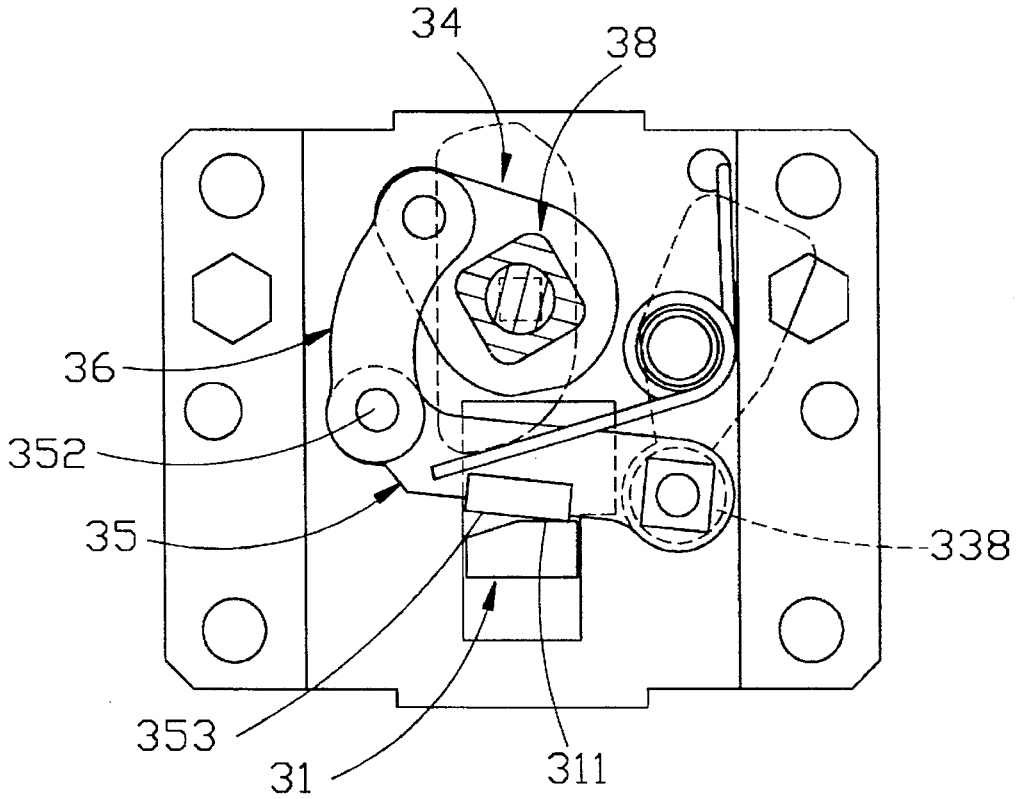

When the lock assembly is mounted on a door, the lever 31 can be operated from the outside of the door and the inside knob (not shown) which is connected to the spindle 71 can be operated from the inside of the door. When the lever 31 is pressed downward, it turns about the pivot pin 32, and the drive end 311 of the lever 31 pushes the prong 353 of the lever actuated plate 35 against the biasing force of the spring 42, as shown in FIGS. 5 and 6. As a result, the lever actuated plate 35 turns upward about the circular hole 338 of the cover plate 33, and the connecting plate 36 and the transmission plate 34 are pushed upward by the lever actuated plate 35. The transmission plate 34 in turn rotates the transmission rod 38 to retract the latch (not shown) connected to the transmission rod 38.

Figure 7:
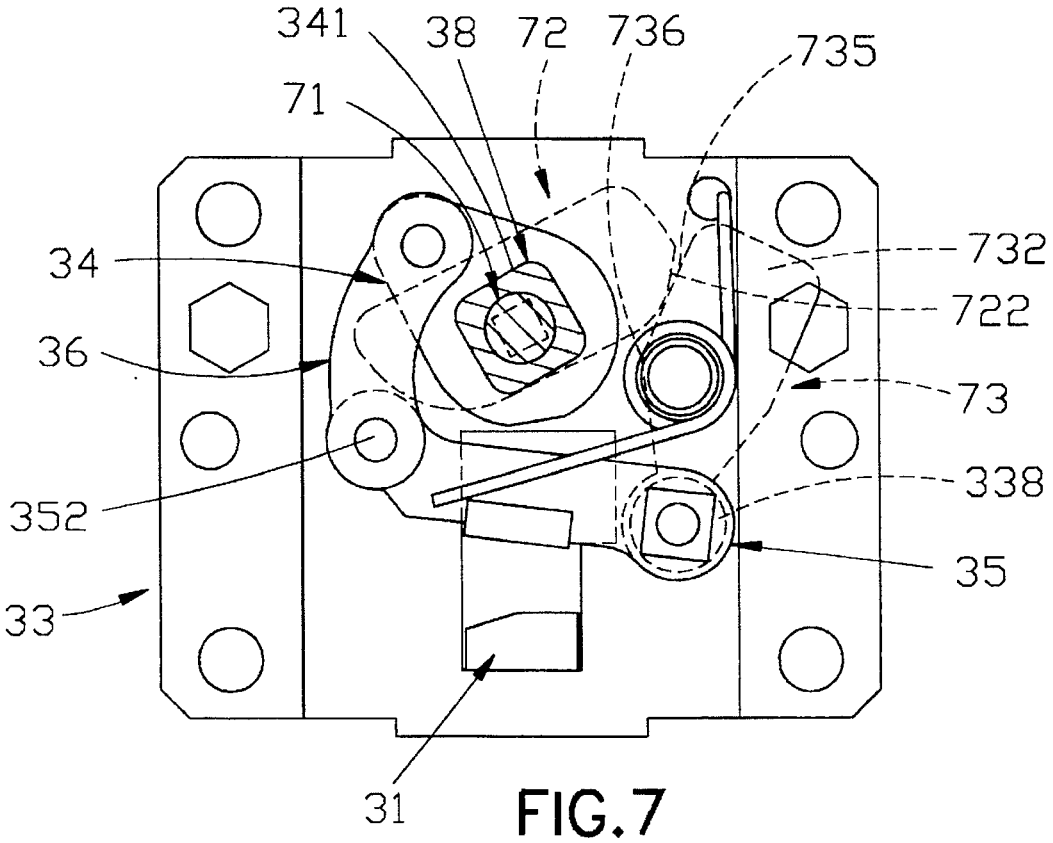
FIGS. 7 and 8 show the operation of the linkage mechanism by manipulating the inside operating spindle of a knob.
Figure 8:
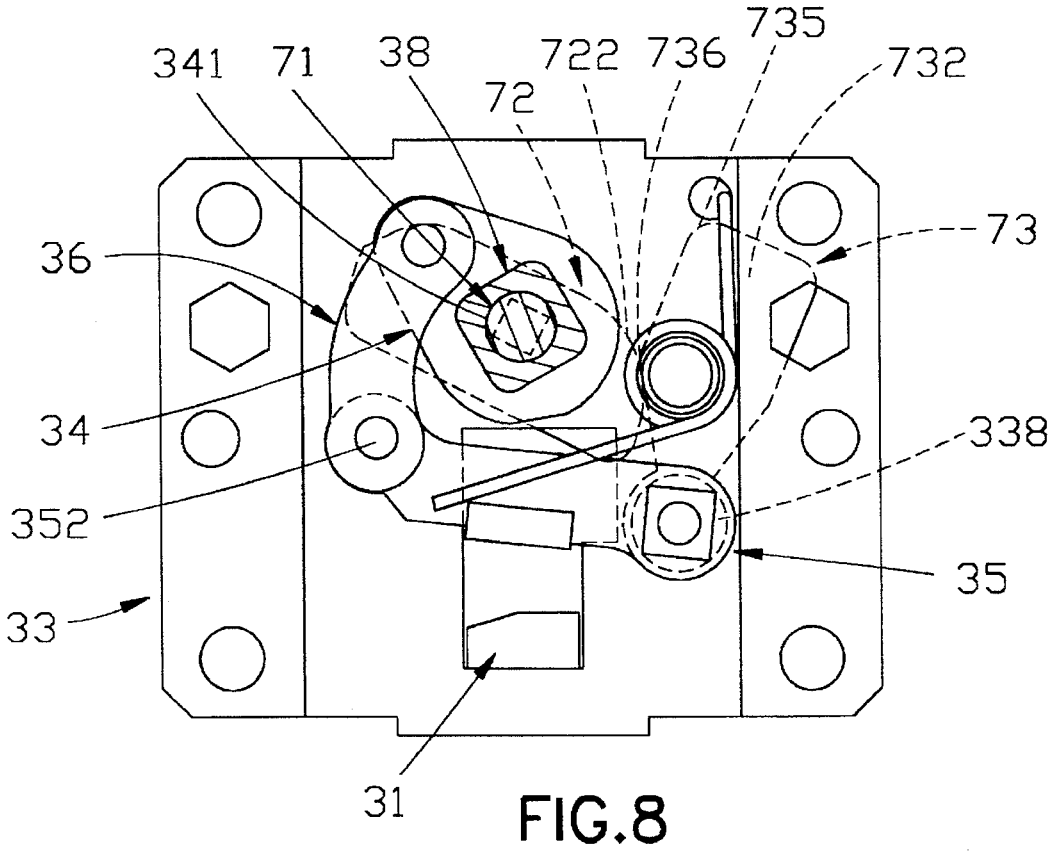

By rotating the inner knob, the spindle 71 can be rotated clockwise as shown in FIG. 7, or counterclockwise as shown in FIG. 8. As the spindle rotates, the cam member 72 is turned and the camming face 722 thereof pushes the bearing face 735 (FIG. 7) or 736 (FIG. 8) of the crank plate 732. The crank member 73, therefore, makes an angular displacement which causes the lever actuated plate 35 to also turn about the circular hole 338. As a result, the transmission plate 34 and the transmission rod 38 rotate simultaneously and the latch is thereby retracted.

Figure 9:
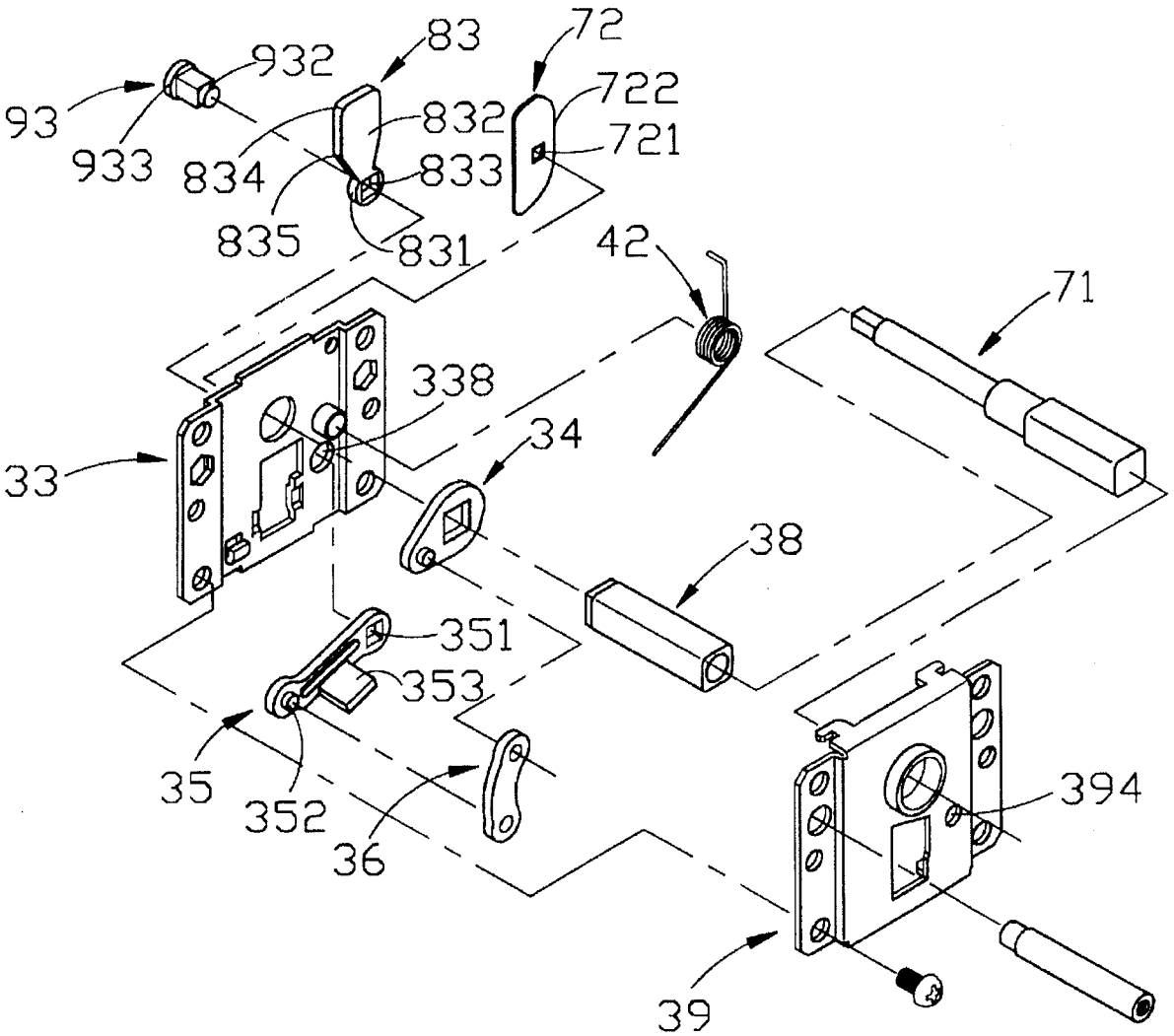
FIG. 9 shows another embodiment of the present invention.

FIG. 9 shows another embodiment of the present invention in which the same components as those of the previous embodiment are denoted by the same reference numerals. In this embodiment, a crank member 83 comprises a crank plate 832 which has a rectangular hole 833 and two bearing faces 834 and 835. A stud 93 which has a rectangular cross-section is inserted into the rectangular hole 833 and protrudes from the crank plate 832 as a crank shaft. The stud 93 has a head 933 and an opposite circular end 932 to be mounted in the hole 394 of the cover plate 39.

Figure 10:
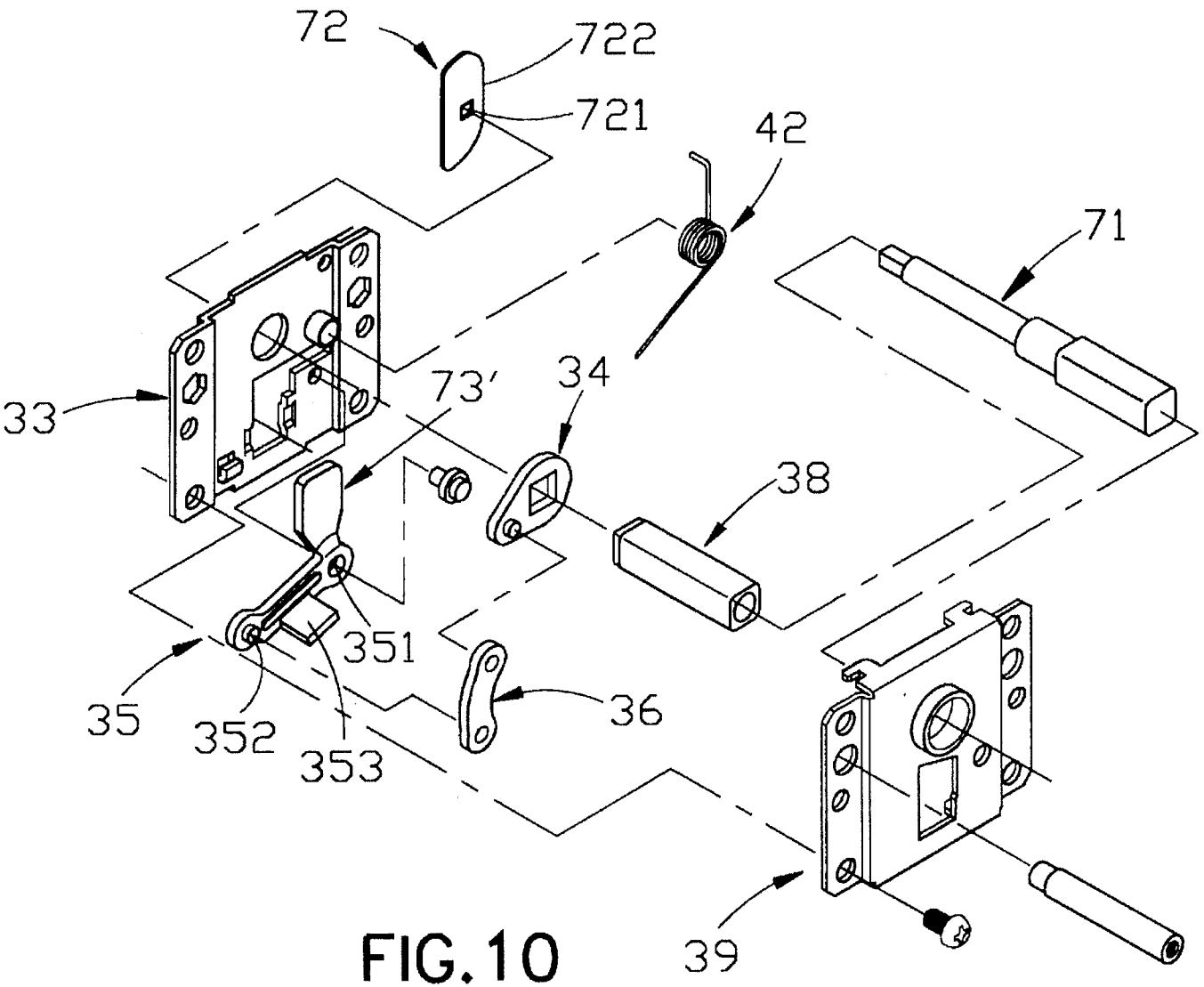
FIG. 10 shows a further embodiment of the present invention.

FIG. 10 shows still another embodiment of the present invention in which a crank plate 73' is one piece with the lever actuated member 35 of the linkage mechanism.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A lock assembly for controlling a latch which locks a door comprising:

a housing to be mounted on an outside of the door, having a base wall;

an outside operating member mounted on said base wall for manipulation at the outside of the door and having a drive end which extends into said housing through said base wall;

a linkage mechanism operable by said outside operating member which is mounted on said base wall inside said housing adjacent to said drive end;

a transmission rod connected to said linkage mechanism to retract said latch when said outside operating member is operated, said transmission rod having an axis of rotation;

an inside operating spindle for extending into said housing from an inside of the door for manipulation;

said linkage mechanism including a transmission plate mounted coaxially with and drivingly connected to said transmission rod for simultaneous rotation;

a spindle operated mechanism mounted inside said housing and including a cam member and a crank member;

said cam member being turnable, independently of said linkage mechanism, about an axis parallel to and offset from said axis of rotation of said transmission rod, said cam member being connected to said inside operating spindle for simultaneous rotation therewith;

said crank member being turnable about an axis parallel to and offset from said axis of said cam member, said cam member having a camming face capable of pushing said crank member, said crank member transmitting movement of said cam member to said linkage mechanism so as to retract said latch when said inside operating spindle operates.

2. A lock assembly as claimed in claim 1, wherein said transmission plate has a rectangular hole, said transmission rod having a rectangular cross-section, and said transmission plate being sleeved onto said transmission rod.

3. A lock assembly as claimed in claim 2, wherein said axis of rotation of said cam member coincides with the axis of rotation of said transmission rod, said transmission rod having a through-bore, said operating spindle rotatably passing through said through-bore and having an end to engage and rotate said cam member independently of said transmission rod.

4. A lock assembly as claimed in claim 3, wherein said crank member comprises a crank plate having a bearing face to be acted upon by said cam member and a crank shaft connected to said linkage mechanism.

5. A lock assembly as claimed in claim 4, wherein said outside operating member is a press lever having said drive end extending into said housing through said base wall, and wherein said linkage mechanism further comprises a lever actuated member mounted turnalby on said base wall about an axis parallel to and offset from said axis of said transmission rod, said lever actuated member moving to said transmission plate and said transmission rod when said press lever is pressed.

6. A lock assembly as claimed in claim 5, wherein said crank shaft is an integral protrusion formed on said crank plate, said crank shaft being coinciding with said axis of said lever actuated member.

7. A lock assembly as claimed in claim 5, wherein said crank plate has a rectangular hole and said crank shaft is a stud of rectangular cross-section which engages said rectangular hole and protrudes from said crank plate, said crank shaft being coinciding with said axis of said lever actuated member.

8. A lock assembly as claimed in claim 5, wherein said crank member is one piece with said lever actuated member, said axis of rotation of said crank member being coinciding with said axis of said lever actuated member.

* * * * *